United States Patent [19]

Okagami

[11] 4,273,406

[45] Jun. 16, 1981

[54] ELECTRICAL CORD ADAPTER

[75] Inventor: Kuni Okagami, Kawaniski, Japan

[73] Assignee: Mitsuoka Electric Mfg. Co., Ltd., Tondabayashi, Japan

[21] Appl. No.: 974,023

[22] Filed: Dec. 28, 1978

[51] Int. Cl.[3] ..... H01R 3/00; H01R 13/514

[52] U.S. Cl. ..... 339/147 P; 339/196 R; 339/206 P

[58] Field of Search ..... 339/147, 139, 196, 209, 339/206, 63, 138, 140

[56] References Cited

U.S. PATENT DOCUMENTS

| | | | |
|---|---|---|---|
| 1,143,937 | 6/1915 | Both | 339/139 R |
| 1,533,691 | 4/1925 | Both | 339/139 R |
| 3,747,049 | 7/1973 | Cressman | 339/206 P X |
| 3,781,765 | 12/1973 | Schleicher | 339/206 P X |
| 3,833,821 | 9/1974 | Weaver | 339/209 X |

FOREIGN PATENT DOCUMENTS

| | | | |
|---|---|---|---|
| 2633673 | 2/1978 | Fed. Rep. of Germany | 339/147 P |

*Primary Examiner*—John McQuade
*Assistant Examiner*—John S. Brown

[57] ABSTRACT

An adapter male electrical fitting to be received in a plug receptacle and connected to the end of the power cord of a household electric appliance, such as an electric shaver, radio or television set. The adapter is cylindrical, in which a transformer for ac-dc conversion or for stepping up or down the voltage is received, which transformer has a pair of plug blades or contact-making blades integrally attached thereto, thereby improving the efficiency of adapter assembly and reducing the size of the adapter.

9 Claims, 9 Drawing Figures

40
41
43
42
42a
44a
44b
44c
44d
44e
44
27
28
26
11
24
6a
20
6
21
23b
22
23a
29
25
38
38a
37e
37f
37d
39
36
30
35a
50
32
33

ELECTRICAL CORD ADAPTER

BACKGROUND OF THE INVENTION

The present invention relates to an adapter attached to the end of a power cord of a household electric appliance, such as an electric shaver, radio or television set.

Known adapters have two parts, a casing and a lid, and they contain a transformer of which the primary wires are connected to a pair of plug blades while the secondary wires go to a power cord of an electric appliance. The latter is energized by inserting the blades into a wall-type receptacle to supply power to the appliance.

The attachment of the blades to the casing is usually effected by inserting inner end portions of the blades into apertures in the casing so that the base portions project into the casing, then mixing these portions to pedestals that are integrally formed on the casing by screws or by solder, the primary wires being fixed to the blades.

It is clear from the above that the transformer has to be inserted in the casing which already has the blades attached thereto, and the soldering of the primary wires to the blades has to be performed through a very narrow clearance between the casing and the transformer, which means that the efficiency of operation is extremely low. To avoid this difficulty, it would be necessary to increase the size of the casing, which is undesirable.

SUMMARY OF THE INVENTION

Accordingly, a first object of the present invention is to improve the efficiency of adapter assembly operation. According to the invention, this object is achieved by integrally fixing plug blades to a transformer, not to a casing as in the prior art, and soldering primary lead wires of the transformer to the plug blades, already integrally fixed to the transformer, before they are received in the casing, thereby avoiding the awkward soldering operation which would otherwise be performed in a narrow clearance within the casing.

Further, the prior-art adapter is limited in the location at which the plug blades are attached to the casing, with the result that the shape of the entire assembly is necessarily rectangular, which is undesirable from the standpoint of external appearance.

In contrast thereto, according to the invention, since the transformer is received in the casing with the plug blades already attached thereto, the position of the plug blades relative to the casing is no longer limited as in the prior art, so that the casing and the lid can be made in the form of bottomed cylinders. Accordingly, a second object of the invention is to provide a cylindrical adapter of improved external appearance.

Further, this type of prior-art adapter has the casing and the lid fixed together by screws. Thus, at least two screws have been necessary in order to firmly fix them together to prevent relative movement therebetween.

In contrast thereto, according to the invention, the casing and the lid are respectively provided with temporary fixing means which interengage to prevent relative movement therebetween, so that only a single screw is needed to firmly fix them together to prevent relative movement therebetween. Accordingly, a third object of the invention is to simplify the casing and lid joining operation.

These and other objects of the invention will become more clear from the following description of an exemplary embodiment of the invention shown in the accompanying drawings.

DETAILED DESCRIPTION OF THE PREFERRED EMBODIMENT

Figure 5:
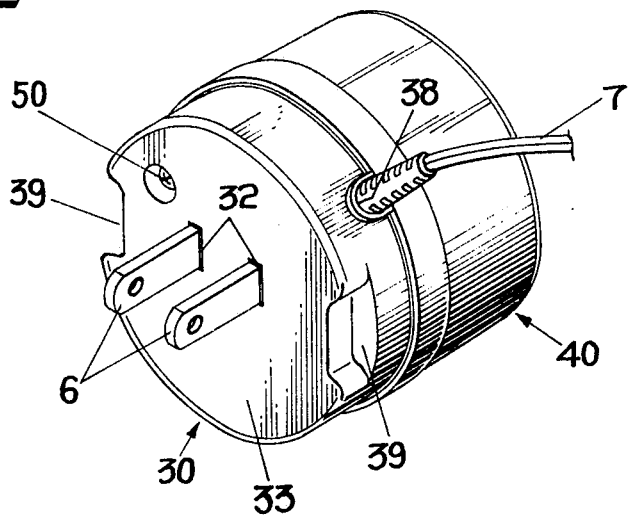
FIG. 5 is a perspective view of the inventive adapter, illustrating the external appearance thereof.
Figure 6:
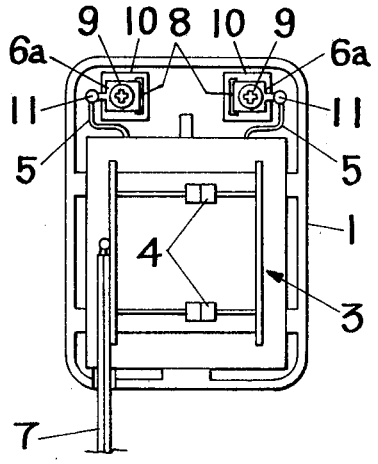
Fig. 6 PRIOR ART
FIGS. 6 and 7 illustrate this type of prior-art adapter, FIG. 6 being a rear view, FIG. 7 being a longitudinal section (similar to FIG. 4).
Figure 7:
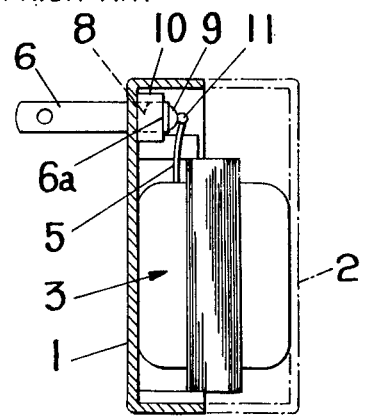
Fig. 7 PRIOR ART

Before dealing with the inventive features, the prior art will be described in more detail with reference to FIGS. 6 and 7. The known type of adapter is divided into two parts, a casing 1 and a lid 2, and contains a transformer 3 for ac-dc conversion and a rectifier or a capacitor 4, primary lead wires 5 of the transformer 3 being connected to a pair of plug blades 6, secondary lead wires being connected to a power cord (e.g. 7 in FIG. 5) of an electric appliance. As is known in the art, the blades 6 are inserted in a plug receptacle (e.g. wall type) to supply power to the electric appliance.

The attachment of the blades 6 to the casing 1 is effected by inserting base or inner end portions 6*a* of the blades 6 into apertures 8 formed in the casing 1 so that the base portions project into the casing 1, then fixing these portions to pedestals 10 that are integrally formed on the casing 1 by screws or paddings of solder as at 9, and/or soldering as at 11, the primary wires 5 to the blades 6 thus being fixed to the casing 1.

Therefore, the transformer 3 has to be received in the casing 1 which has the plug blades 6 attached thereto, as described above, and the operation of soldering the primary wires 5 to the base portions 6*a* of the blades 6 has to be performed through a very narrow clearance between the casing 1 and the transformer 3, which means that the efficiency of operation is extremely low. To avoid this difficulty, it would be necessary to increase the size of the casing 1.

Now follows the description of the novel, inventive adapter for electrical cords.

Figures 1A, 1B, 1C:
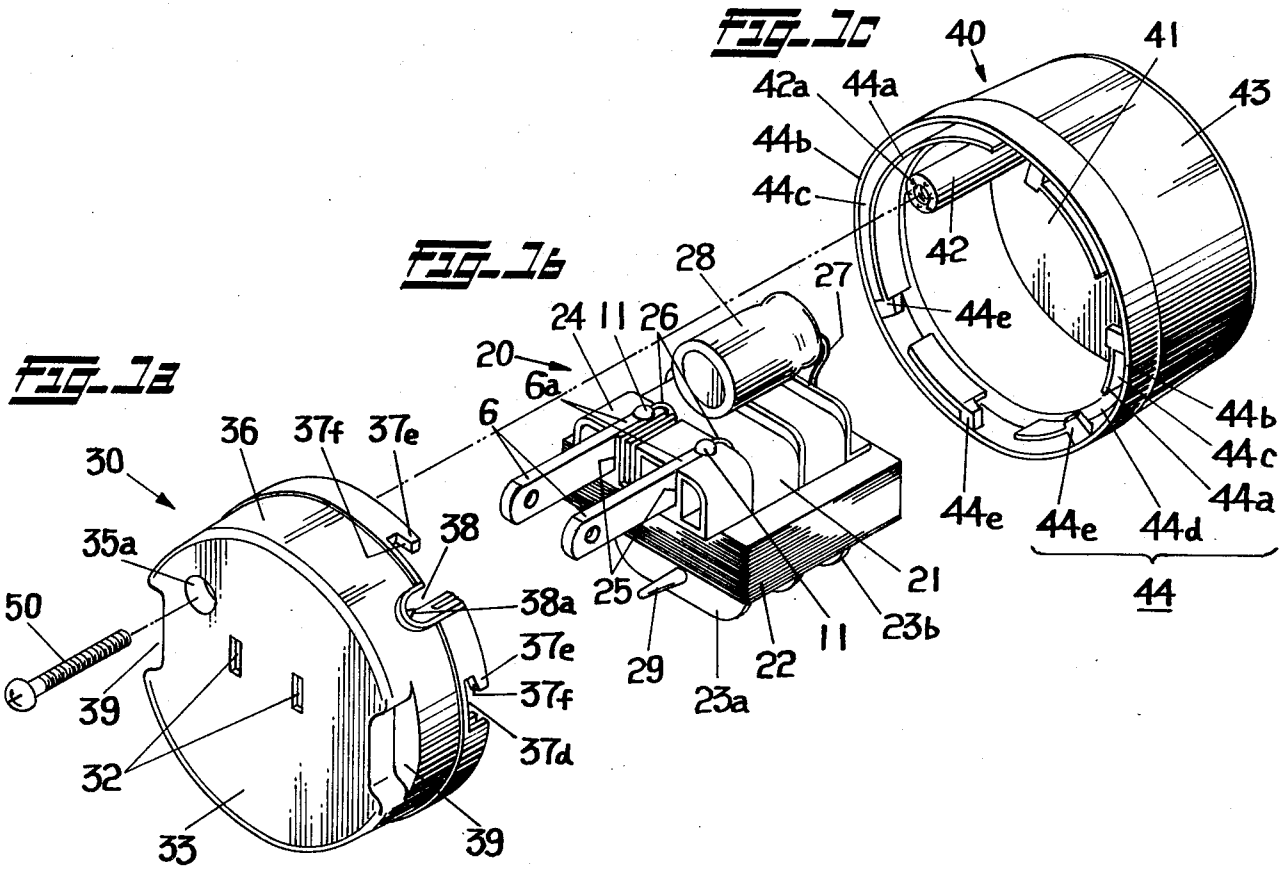
FIGS. 1*a*, 1*b* and 1*c* are exploded perspective views of an adapter according to the invention for electrical cords.

As shown in FIG. 1*b*, a transformer 20 comprises a coil bobbin 21 and an iron core 22. The coil bobbin 21 has flanges 23*a*, 23*b*, one flange 23*a* having a thickened portion which serves as a plug-blade attaching pedestal 24. The pedestal is formed with two parallel slots 25 in which inner ends or base portions 6*a* of plug blades 6 are force-fitted. if the force fit is insufficient to provide the required fixing force, an adhesive agent is used to fix them together.

Primary lead wires 26 emerging from the coil bobbin 21 are soldered as at 11 to the blade base portions 6*a*. Therefore, according to the invention, since the primary lead wires 26 are soldered to the plug blades 6 before they are received in the casing, the operation is facilitated. Moreover, since the primary lead wires 26 extending from the transformer 20 are connected to the plug blades 6 that are integrally fixed to the transformer 20, there will be almost no danger of the wires being broken under tension.

Figure 4:
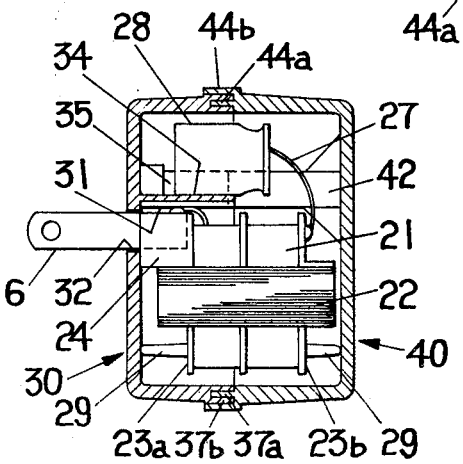
FIG. 4 is a longitudinal section of the adapter.

Secondary lead wires 27 from the transformer 20 have an electrical part such as, for example, a rectifier or smoothing capacitor 28, connected thereto for changing the primary ac voltage into a low or high dc voltage. The flanges 23*a*, 23*b* on the coil bobbin 21 have positioning projections 29 extending therefrom at their outer faces so as to prevent the rattling of the transformer 20 inside the adapter (FIG. 4).

Figure 2:
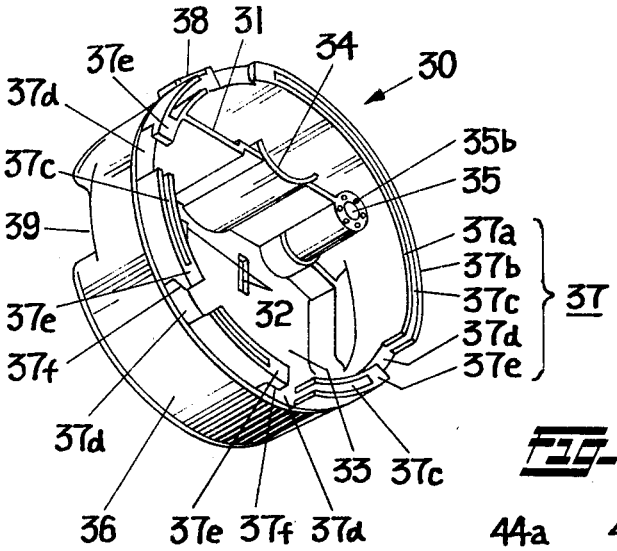
FIG. 2 is a rear perspective view of a casing for the adapter.

The adapter has a casing 30 in the form of a bottomed, generally short cylinder, as shown in FIGS. 1*a* and 2, integrally formed with a partition wall 31 extending from a front wall 33 at the bottom at a relatively upper position thereon toward the open side. Located below the partition wall 31 are a pair of plug blade inserting apertures 32 to be associated with the plug blades 6 and passing through the front wall 33. The transformer 20 is adapted to be received in the casing 30 at the lower side of the partition wall. The partition wall 31 is integrally formed with a rest member or portion 34 for supporting the capacitor or rectifier 28 thereon. Therefore, the partition wall 31 plays the role of a screen or shield for protecting the capacitor 28 against adverse effects of induced currents in the transformer 20. The presence of the partition wall 31 and the rest member 34 also ensures the positioning of the capacitor 28 within the casing 30 to prevent rattling thereof and precludes the shorting of the capacitor 28 and the transformer 20.

A screw inserting pillar 35 is disposed adjacent the partition wall 31, one end of the pillar 35 opening, as at 35*a*, to the front wall 33 (see FIG. 1*a*). The front surface of the screw inserting pillar 35, as shown in FIG. 2, is provided on its front end surface with a plurality of circumferentially arranged small recesses 35*b* for positioning and buffering purposes to be described later.

Further, the open-end edge of a peripheral wall 36 of the casing 30 is provided with temporary fixing means 37. More particularly, the peripheral edge of the wall 36 is formed with two inner and outer clamp walls 37*a* and 37*b* to define a guide groove 37*c* therebetween, the walls 37*a* and 37*b* being notched in an L-shape at a plurality of circumferential places to form L-shaped engaging openings 37*d*. Lower end surfaces 37*f* of engaging steps 37*e* surrounded with the openings 37*d* are tapered for wedge-wise temporary fixing purposes to be described later. In addition, the peripheral-wall edge of the casing 30 is formed with a cord inserting aperture 38 whose inner end surface is provided with a small pointed lateral projection 38*a*, as shown in FIG. 1*a*, so that when a power cord 7 (FIG. 5) is inserted in the aperture 38, it is pierced or at least immobilized by the small projection 38*a*. This arrangement has the effect of overcoming external torsional or tensile forces on the power cord. Reference characters 39 in FIG. 1*a* designate finger receiving recesses formed in the casing 30.

The adapter has a lid 40 which, as shown in FIG. 1*c*, is in the form of a bottomed, generally short cylinder like the casing 30, with an internally threaded pillar 42 extending from a rear wall 41 at the bottom toward the open side, the pillar 42 being so disposed that it will constitute an extension of the screw inserting pillar 35 of the casing 30 when the lid 40 is temporarily fixed. The front end surface of the pillar 42 is provided with small projections 42*a* mating with the recesses 35*b* formed on the pillar 35, so that when the lid 40 is fastened to the casing 30, the recesses 35*b* and projections 42*a* interengage to effect the positioning and buffering of the pillars 35, 42 (see in FIG. 4).

Further, the open end edge of a peripheral wall 43 of the lid 40 is provided with temporary fixing means 44 adapted to engage the temporary fixing means 37 of the casing 30. More particularly, the peripheral edge of the peripheral wall 43 is formed with inner and outer clamp walls 44*a*, 44*b* to define a guide groove 44*c* therebetween. The inner clamp wall 44*a* is notched in an L-shape at a plurality of circumferential places to provide notches 44*d* associated with the L-shaped engaging openings 37*d* formed in the casing 30, while the outer clamp wall 44*b* is provided with engaging claws 44*e* associated with the notches 44*d* and projecting toward the center of the lid.

The transformer 20 is received during assembly in the casing 30 and then the lid 40 is joined to the casing 30. This operation is performed by placing in the casing 30 the transformer 20 into the casing 30, with the plug blades 6 already attached to the transformer, while passing the plug blades 6 in the apertures 32, with the capacitor 28 mounted on the rest member 34, and then engaging the temporary fixing means 37 of the casing 30 with the temporary fixing means 44 of the lid 40 so as to effect temporary fixing.

Figure 3:
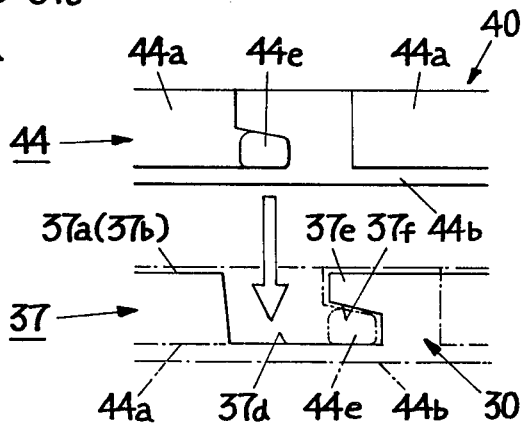
FIG. 3 is a schematic, longitudinal sectional view of temporary fixing means of the casing and a lid, illustrating the function thereof.

More particularly, this is performed by inserting the outer clamp wall 37*b* of the casing 30 in the guide groove 44*c* of the lid 40, and the inner clamp wall 44*a* of the lid 40 in the guide groove 37*c* of the casing 30, and rotating the casing 30 and the lid 40 relative to each other, whereby the engaging claws 44*e* of the lid 40 are moved in the direction of an arrow in solid line in FIG. 3 into the innermost parts of the engaging apertures 37*d* to engage the tapered contact surfaces 37*f* of the engaging steps 37*e*, thereby effecting wedge-wise temporary fixing.

In this manner, the engagement between the temporary fixing means 37 of the casing 30 and the mating temporary fixing means 44 of the lid 40 fixes the two together to preclude rattling thereof, and finally a single screw 50 is screwed from the opening 35*a* in the front wall 33 of the casing, through the pillar 35 into the pillar 42 of the lid 40. The coupling force of the screw 50, cooperating with said temporary fixing means 37, 44, integrally fixes the casing 30 and the lid 40 together, providing a cylindrical adapter of improved external appearance, as shown in FIGS. 4 and 5.

What is claimed is:

1. An adapter for electric cords, comprising a transformer with a coil bobbin, having plug blades integrally attached thereto; a bottomed, generally cylindrical casing having apertures for receiving said blades and at least one screw inserting aperture formed in its front wall; a bottomed, generally cylindrical lid complementary to said casing and having an internally threaded lid pillar extending from a rear wall surface of said lid toward an open side; temporary fixing means provided on said casing and said lid, respectively, for engagement with each other; wherein said temporary fixing means include first inner and outer clamp walls to define a guide groove therebetween, provided on a peripheral wall of said casing, second inner and outer clamp walls to define a guide groove therebetween, provided on a peripheral wall of said lid, for engaging said first clamp walls, L-shaped apertures formed by notching said first clamp walls, and claws projecting from said second clamp walls for engaging said apertures; and at least one screw for interconnecting said casing with said lid.

2. The adapter as defined in claim 1, wherein said bobbin has flanges, one of which is thickened to serve as a pedestal formed with slots for receiving therein inner ends of said blades.

3. The adapter as defined in claim 2, wherein said flanges are formed with positioning projections.

4. The adapter as defined in claim 1, wherein said casing is provided with a partition wall extending from said front wall toward said open side, and an electrical part and said transformer are received in said casing with said partition wall intervening therebetween.

5. The adapter as defined in claim 4, wherein said partition wall has a support portion for mounting said electrical part thereon.

6. The adapter as defined in claim 1, wherein said L-shaped apertures have end surfaces for engaging said claws, said end surfaces being tapered in the fixing direction.

7. The adapter as defined in claim 1, further comprising a power cord inserting aperture formed in said casing, which aperture has a small lateral projection for engaging a power cord.

8. The adapter as defined in claim 1, wherein said lid pillar extends from said rear lid wall surface toward said open side relative to said screw inserting aperture which latter is in a casing pillar, so that upon temporary fixing of said lid, said lid pillar is positioned as an extension of said casing pillar.

9. The adapter as defined in claim 8, wherein opposed end surfaces of said casing pillar and of said lid pillar are respectively provided with small recesses and small mating projections.

* * * * *